United States Patent [19]

Puri et al.

[11] Patent Number: 4,756,367

[45] Date of Patent: Jul. 12, 1988

[54] METHOD FOR PRODUCING NATURAL GAS FROM A COAL SEAM

[75] Inventors: Rajen Puri; Dan Yee, both of Tulsa; John P. Seidle, Jenks, all of Okla.

[73] Assignee: Amoco Corporation, Chicago, Ill.

[21] Appl. No.: 43,511

[22] Filed: Apr. 28, 1987

[51] Int. Cl.[4] ..... E21B 43/30; E21B 43/40

[52] U.S. Cl. ..... 166/263; 166/245; 166/266; 166/268

[58] Field of Search ..... 166/245, 263, 266, 267, 166/268, 305.1, 369, 370

[56] References Cited

U.S. PATENT DOCUMENTS

| | | | |
|---|---|---|---|
| 657,951 | 9/1900 | Mooney | 166/305.1 |
| 1,198,078 | 9/1916 | Squires | 166/245 |
| 2,240,550 | 5/1941 | Conlon, Jr. | 166/268 X |
| 2,342,165 | 2/1944 | Plummer | 166/266 X |
| 3,468,129 | 9/1969 | Knutson | 166/305.1 |
| 3,580,336 | 5/1971 | Meldau | 166/267 |
| 3,809,159 | 5/1974 | Young et al. | 166/258 |
| 4,043,395 | 8/1977 | Every et al. | 166/268 X |
| 4,089,374 | 5/1978 | Terry | 166/369 X |
| 4,544,037 | 10/1985 | Terry | 166/369 |

OTHER PUBLICATIONS

Elder, Curtis H., "Degassification of the Mary Lee Coalbed Near Oak Grove, Jefferson County, Ala., by Vertical Borehole in Advance of Mining", U.S Bureau of Mines, 1974.

*Primary Examiner*—George A. Suchfield

*Attorney, Agent, or Firm*—Scott H. Brown; Fred E. Hook

[57] ABSTRACT

Disclosed herein is a method of degasification, wherein gas and water production from a coal field are maintained at high rates regardless of temporary changes in market demand. While all the produced water is disposed, surplus gas is reinjected in coal by converting some of the producers to injectors. When the demand for gas improves, the injection wells are put back on production. Recovery of gas from wells used as injectors is rapid because of increased reservoir pressure and high gas relative permeability near the wellbore.

7 Claims, 6 Drawing Sheets

Five Wells In Field

I -Produce Corner Wells & Inject Center Well When No Gas Demand

II -Shutin All Wells When No Gas Demand

Typical Coal Adsorption/Desorption Isotherm

FIG. 2: Water Relative Permeability Curves

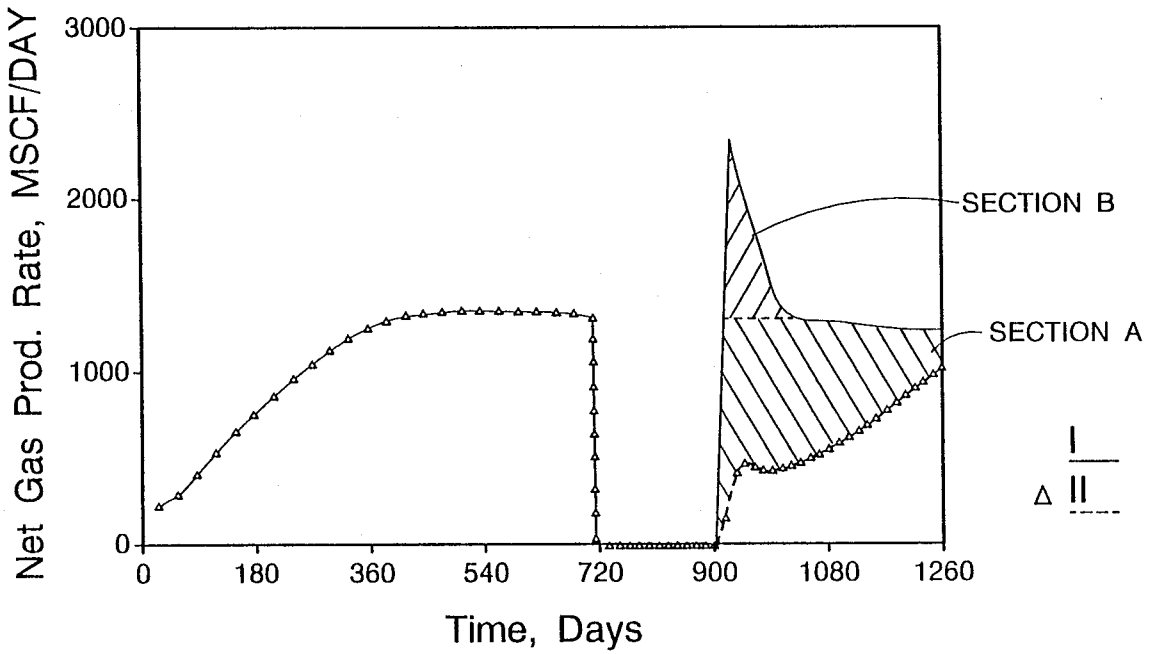
FIG.6: Five Wells In Field
I –Produce Corner Wells & Inject Center Well When No Gas Demand
II –Shutin All Wells When No Gas Demand

METHOD FOR PRODUCING NATURAL GAS FROM A COAL SEAM

FIELD OF THE INVENTION

The present invention relates to the production of natural gas from coal seams penetrated by a plurality of wells. More particularly, the present invention pertains to a method of recovering natural gas from a coal seam that prevents or inhibits water invasion of the coal seam.

BACKGROUND OF THE INVENTION

The natural gas found in coal is believed to have originated from the coal during its formation; and as such, coal is both the source and the reservoir rock. The natural gas in coal is typically composed of methane, more so than natural gases from other sources. Hence, this resource is commonly called coalbed methane.

Coal has the ability to hold large quantities of natural gas despite its low porosity. The reason for this large storage capacity is that the natural gas is stored as an adsorbed gas at near liquid density. This adsorption capacity is related to the fine pore structure of coal, where the majority of the porosity exists as micropores whose size is just slightly greater than molecular dimensions. These micropores result in a large internal surface area which can easily exceed 100 $m^2$/gm, and it is on this large surface area where the natural gas molecules are held by adsorption.

This fine pore structure is nearly absent in sandstone and carbonates. For example, a sandstone has an internal surface area closer to 1 $m^2$/gm. In these types of reservoirs, the natural gas is stored in less concentrated form as free gas. As a result, much greater porosities than those found in coal are required in sandstones or carbonates in order to store an equivalent amount of natural gas. For example, a 20 ft coal seam having a density of 1.5 gm/cc and a gas content of 500 SCF/ton contains over 13 BCF/section. A sandstone or carbonate of the same thickness would need a porosity of over 34% to have the same amount of gas-in-place at reservoir conditions of 1000 psia and 100° F.

While gas is primarily stored in the micropores of the matrix, water is stored in the natural fractures of the coal—called cleats. It is through this cleat system that the microporous matrix is connected to a well drilled into the coal seam.

Usually, the coalbed methane production process begins by drilling at least one wellbore into the coal seam. At first a well typically produces water, contained in the cleat networks of the coal seam, and a small proportion of gas from the coal matrix. As the cleats are dewatered, the reservoir pressure near the wellbore is reduced. This lowering of reservoir pressure releases some gas from the surface of the coal. The gas migrates from the micropores of the coal matrix into the cleats. As water is produced from the coal, the water saturation in the cleats is reduced and the ability of the gas to flow in preference to water improves, i.e., the relative permeability to gas increases.

Most coal seams are also water aquifers. Consequently, an important consideration in a coalbed methane recovery project is the rate at which water migrates from the flanks of the coal seam into the coal cleats adjacent to the wellbore. In order to maintain or improve gas deliverability of a well, continuous production of fluids can be essential. If several wells in a field are shut-in for a considerable period of time, it is possible that water can invade the dewatered portions of the coal seam. Therefore, when the wells are put back on production, resumption of gas recovery at rates comparable to those achieved prior to shut-in may take considerable time and effort. The water influx to a coal well can have significantly reduced the gas relative permeability of coal during the shut-in period.

In commercial coalbed methane recovery projects, lack of demand for gas often forces operators to temporarily shut in some or all of the wells. Over time, the cleat networks in the coal adjacent the shut-in wells will be invaded with water originating from the flanks of the coal seam. As a result, the cleats in the coal adjacent to the wellbore have to be dewatered again before significant gas production resumes. Under some circumstances, it can take several months for the gas rates to return to the pre-shut-in production rates. Unfortunately, this lag period usually occurs when high gas rates are required to meet demand. If the demand for gas fluctuates routinely during the life of a coalbed methane recovery project, then shutting in wells during low demand and producing them during high demand can become a very inefficient method of operating a coalbed methane recovery project.

An alternative to shutting in the wells is to flare the excess gas. This has the desirable effect of keeping the cleat networks in the coal adjacent the well saturated with gas, but it has the undesirable effect of reducing total amount of natural gas available for sale, thereby wasting precious natural resources. There is a need for an alternative to shutting in wells during low demand for natural gas produced from coal seams without flaring the gas.

U.S. Pat. No. 4,544,037 to Terry discloses a method of initiating production of methane from wet coalbeds. The abstract states, "Rather than pumping water to lower the hydraulic head on the seam to permit desorption of methane within the coal, high pressure gas is injected into the seam to drive water away from the wellbore. Gas injection is terminated, and the well is open to flow". This patent does not disclose or suggest any method to handle fluctuations in gas demand in a coalbed methane project. Nor does it address means to minimize water influx during well shut-in.

In an article published in Ninth World Energy Conference Transaction, Vol. 2, 1975, pp. 103–118, the use of abandoned coal mines for gas storage is recommended. Although storing surplus gas in the void areas created in a coal seam after mining operations have been completed can be a feasible alternative to shutting in coalbed methane wells when gas demand is low, an abandoned coal mine may not be located close to a coalbed methane recovery project.

U.S. Pat. No. 4,623,283 to Chew discloses methods for preventing the introduction of water from a sandstone above the coal seam into a mine cavity from which combustion process gases are removed. All of the methods provide a barrier between the water sand and the mined coal cavity to prevent excessive water influx. The Chew patent does not disclose or suggest any techniques for inhibiting the migration of water within the coal seam itself during well shut-in.

There is a need for an efficient method of operating a coalbed methane recovery project when the demand for gas fluctuates during the life of the project without allowing the migration of water to invade the coal cleats adjacent to a wellbore. There is a need for an efficient method of producing gas from a coal seam at reduced rates during low demand without flaring the gas produced, and subsequently producing at high rates during high demand.

SUMMARY OF THE INVENTION

The present invention involves a method for producing gas from a coal seam penetrated by at least two wells, comprising removing natural gas and liquid from the coal seam through at least one of the two wells, separating natural gas from the liquid, and injecting at least a portion of the separated natural gas into the coal seam through a second of at least two wells while continuing to remove natural gas and liquid from the coal seam.

By utilizing the present invention, the operator of a coalbed methane recovery field can avoid dewatering the coal seam each time the demand for natural gas produced from the coal fluctuates without the need for flaring the natural gas. By continuing to produce natural gas from the coal seam, a high relative permeability to gas can be maintained in the coal cleats adjacent to the producing wells. While gas is continuously flowing through the coal cleats it is difficult for water at the flanks of the coal seam to invade the coal cleats adjacent to the producing wells. By reinjecting the natural gas back into the coal seam, the gas can be temporarily stored until demand increases.

BRIEF DESCRIPTION OF DRAWING

FIG. 6 is a schematic diagram illustrating the comparison of gas rates from a coal field comprising 5 wells after the gas production was shut in and after the field is put on complete recycle.

DETAILED DESCRIPTION OF THE PREFERRED EMBODIMENT

Figure 1:
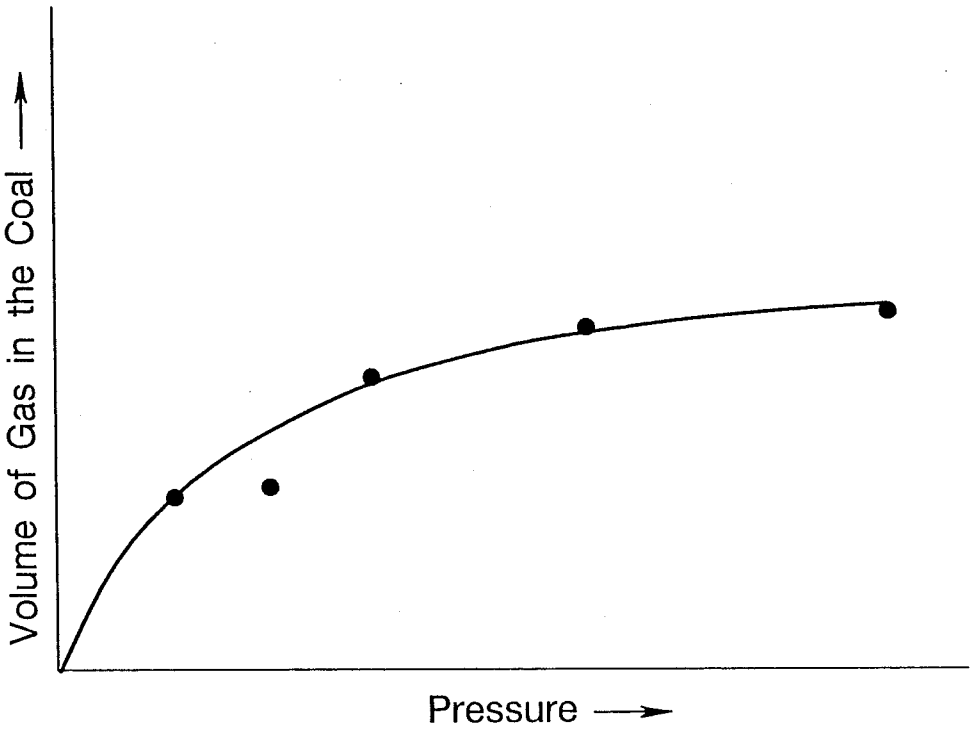
FIG. 1 is a schematic diagram illustrating that the volume of natural gas contained in coal is a function of reservoir at a fixed temperature.
Figure 2:
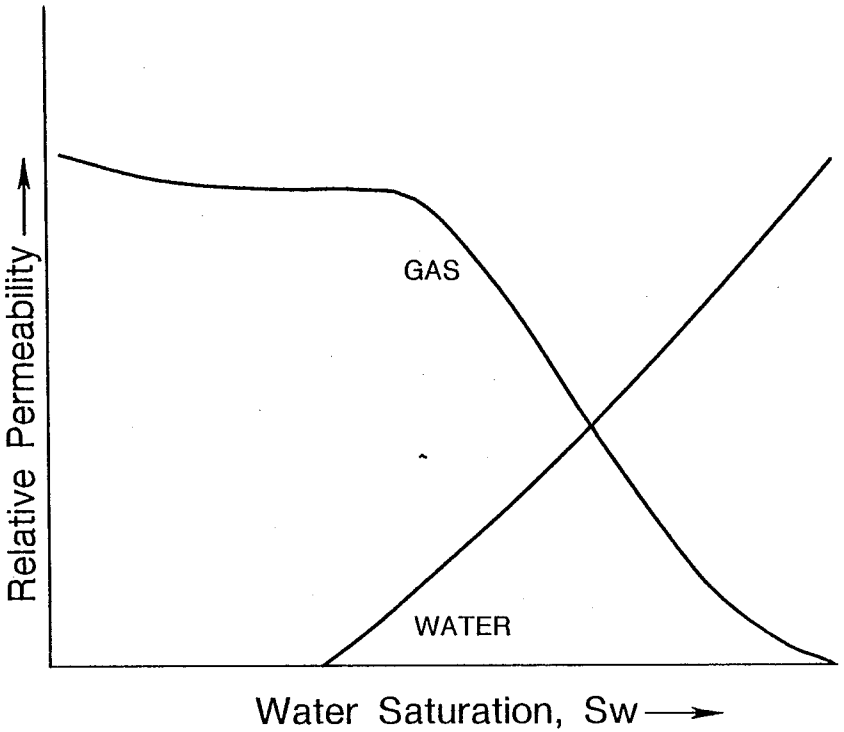
FIG. 2 is a schematic diagram illustrating how the relative permeability to gas and water in a coal seam may vary as a function of water saturation in the coal seam.

In the degasification of a coal seam, a plurality of wells are drilled through the coal seam to produce natural gas contained within the coal adjacent to the wells. Initially, the wells produce as a major portion water and as a minor portion gas, because the high initial water saturation in the coal cleats adjacent to the wells reduces the relative permeability to gas and the high reservoir pressure inhibits the desorption of natural gas from the surface of the coal adjacent the wellbores. As is known to those skilled in the art, the amount of natural gas stored in a coal seam at a fixed temperature is dependent upon reservoir pressure, as shown in FIG. 1. As the reservoir pressure decreases, the amount of gas stored in the coal seam likewise decreases. FIG. 2 illustrates that when the water saturation in the coal seam is relatively high in comparison to the gas saturation, the relative permeability to gas is low. Correspondingly, when the water saturation in the coal seam is low, the relative permeability to gas is high, and the gas saturation is high.

After the water saturation in the coal cleats adjacent to the wellbore has been reduced, the mobility to the natural gas adsorbed within the coal improves. At the same time, the reservoir pressure is reduced thereby allowing greater amounts of natural gas to desorb off the surface of the coal and migrate through the coal cleats into the wellbore. Unfortunately, the reservoir pressure drops simultaneously which will inevitably reduce the gas production rate. The inventors have discovered a method of operating a coalbed methane project that restores some of the reservoir pressure lost during production, slows water influx from any surrounding aquifer, and improves the gas relative permeability of the cleat system. The benefits of this method is that when gas demand improves, the gas rate can be increased immediately rather than having to wait (in some cases up to several months) for the coal to rid itself of water that invaded the coal cleats adjacent to the well while the well was shut in.

Figure 3:
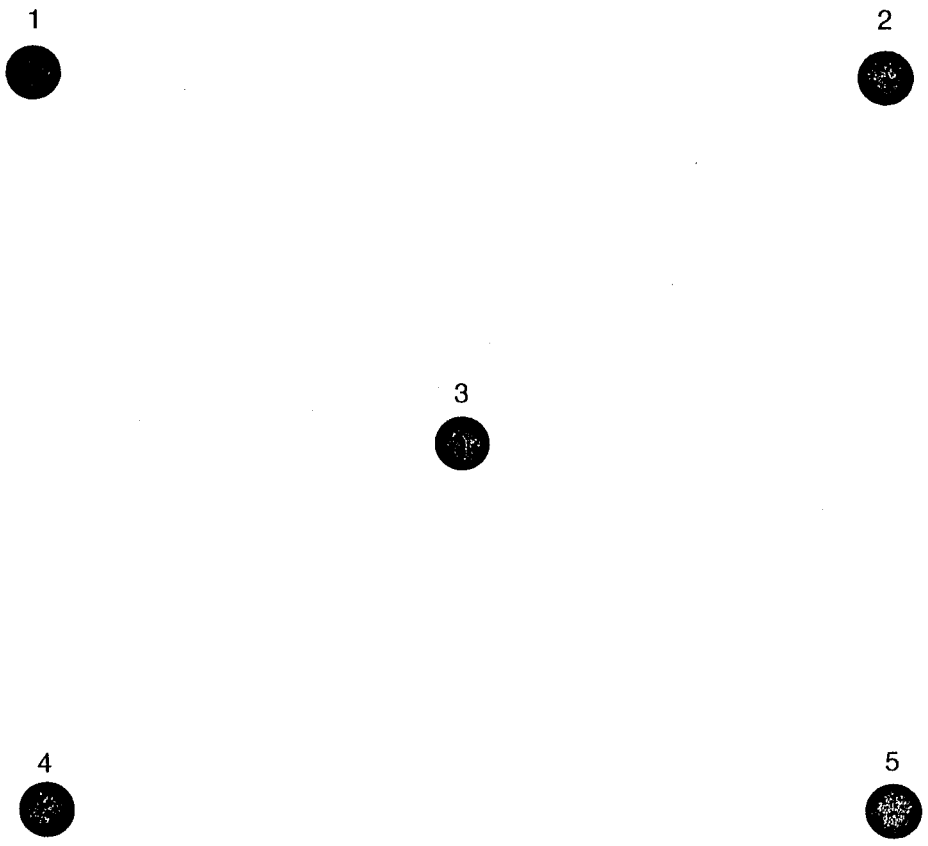
FIG. 3 is a schematic diagram illustrating a five-spot well pattern the demand for gas is high and all of the wells in the coal field are producing.

FIG. 3 illustrates a top view of a five-spot well pattern penetrating a coal seam. The wells, numbered 1 through 5, are indicated by filled-in circles, to show that all of the wells are on production due to high demand for the natural gas produced. The pressure in the coal seam is being reduced and the coal cleats adjacent to all of the wells are partially saturated with gas. The invasion of water from the flanks of the coal seam does not cause operational problems, so long as gas production is not disrupted.

Figure 4:
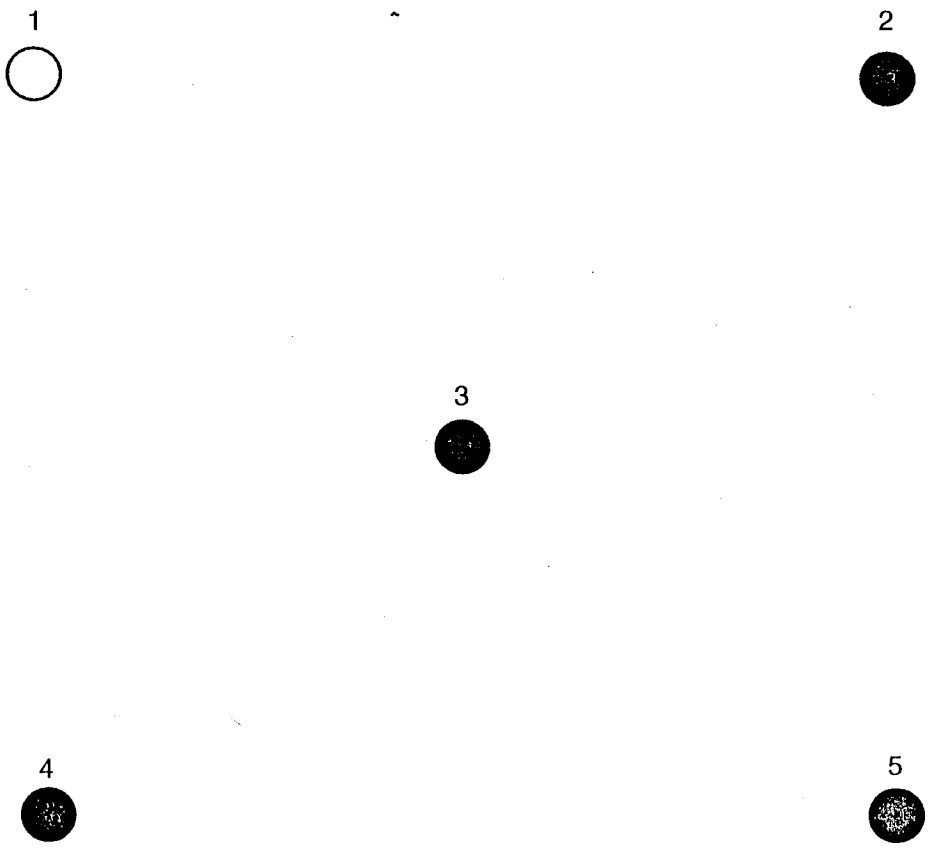
FIG. 4 is schematic diagram illustrating a five-spot well pattern where demand for gas is curtailed and partial recycling of gas occurs.

FIG. 4 illustrates the top view of a five-spot well pattern penetrating the coal seam where the net gas rate to sales has been curtailed due to low demand for gas. In this situation, Well No. 1 has been converted to an injection well (indicated by an open circle) and surplus gas from the field, produced from Well Nos. 2, 3, 4, and 5 or any combination thereof, is being injected into Well No. 1. Surplus gas is defined as any natural gas produced from a well penetrating the coal seam and cannot be sold due to low demand for it. During this recycling process, the coal cleats adjacent Well Nos. 2, 3, 4 and 5 are being dewatered since the production of gas has not been disrupted. This has the beneficial effects of maintaining the coal seam's ability to flow gas. At the same time, the coal matrix and cleats adjacent to Well No. 1 are being filled with gas under pressure so that later, when the net gas rate to sales can be increased, the gas stored in the coal matrix and cleats will be produced at a rapid rate, as will be described below.

Figure 5:
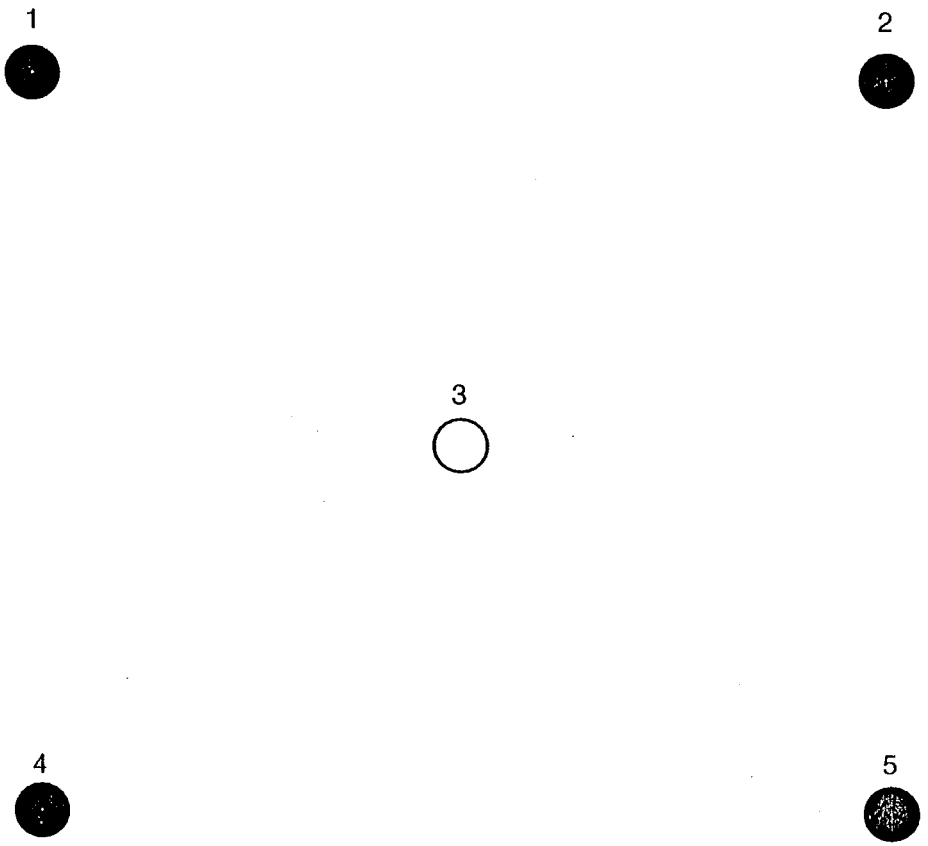
FIG. 5 is a schematic diagram illustrating a 5 spot well pattern where demand for gas is reduced and complete recycling of gas occurs.

FIG. 5 illustrates the top view of a five-spot well pattern penetrating a coal seam where the demand for gas is at its lowest point. In this scenario, no gas is being sent to the gas sales line. However, the gas production from Well Nos. 1, 2, 4 and 5 continue without disruption. In this example, Well No. 3 has been converted to an injection well (indicated by an open circle) and surplus gas from the field, all of the gas produced from Well Nos. 1, 2, 4 and 5, is being reinjected for temporary storage into the same coal seam from which the gas was produced. During this recycling process, the cleats adjacent to Well Nos. 1, 2, 4 and 5 are continuing to be dewatered, since the production of gas and water has not been disrupted. Therefore, a high relative permeability to gas is maintained around the wellbores. At the same time, the coal matrix and cleats adjacent to the injection Well No. 3 are being filled with gas under pressure so that later, when Well No. 3 is converted back to a producing well, the gas stored in the coal matrix and cleats adjacent Well No. 3 will be produced at a rapid rate. Reinjection of surplus gas during low demand and later production of surplus gas during high demand will minimize water invasion problems caused by shutting in wells by maintaining a high relative permeability to gas in the coal cleats adjacent to the producing wells. If the production of natural gas is interrupted, such as shutting the wells in due to low demand, the coal seams preference for flowing water increases, and it becomes easier for water at the flanks of the coal seam to invade the coal cleats adjacent to the wells.

As an example case, a computer simulation was conducted on a coal field penetrated by five wells. The simulated coal degasification field was operated at a maximum rate for 720 days, then demand subsided to zero for 180 days, and resumed to full demand thereafter. FIG. 6 illustrates how the net gas rate to sales varied over time. Curve 1 represents the situation where all of the gas produced from the field, in accordance with the present invention, was reinjected for 180 days into the coal seam from which it was previously produced and Curve 2 represents the situation where all of the wells were shut-in for the same period, i.e., no gas was produced from the coal seam.

Both curves track each other exactly for the period of 720 days preceding the no demand period. For the first 15 days the net gas rate to sales is zero. During this period the wells are in the process of dewatering. At this time, the coal seam's pressure and relative permeability to water are high. Therefore, the natural gas adsorbed onto the coal surface is inhibited from releasing and flowing through the coal cleats into the wellbores. By the first 450 days of operation, the gas rate has climbed steadily to a rate of 1350 MSCF/day, at which it approximately remains for the next 270 days.

After 720 days of operating at full capacity, the demand for gas to sales is suddenly reduced to zero. Curves I and II again track each other exactly, i.e., both show zero net gas rate for the next 180 days. In Curve I where recycling is occurring, all of the gas produced is injected into the coal seam from which it was produced so that it may be temporarily stored for recovery at a later time. In Curve II, all the wells are shut-in, therefore, no gas is being produced from the coal seam. In this example, to accomplish recycling, gas produced from four of the five wells is injected into the fifth well at a pressure that is higher than reservoir pressure.

After 180 days of permitting no gas to sales, the demand for gas increases to a point such that the field can be operated at full capacity. It is at this point that Curves I and II begin to depart from each other. It is this departure which indicates the benefits of recycling gas produced from the field, in accordance with the present invention, rather than shutting in the wells. As illustrated in Curve I, after recycling, the gas rate increases at a sharp rate, up to 2400 MSCF/day for the first 30 days then levels off to a rate similar to the pre-recycling rate. However, as illustrated in Curve II, after shutting the field in, the gas rate to sales increases at a very slow rate and fails to reach the pre-shut-in rate even after 360 days, twice the period of time that the wells were shut-in.

The reasons for the difference in gas rates between Curves I and II can best be explained by reference to FIG. 6. The shaded areas in FIG. 6 represent the additional amount of gas produced as a result of reinjecting all of the gas produced back into the coal seam. Section A can be attributed to the continuous production of water and presence of gas in the cleats adjacent to the production well. Due to the presence of gas in the cleats, the coal seam's preference to flow gas is maintained. Section B can be attributed to the storing of surplus gas in the coal matrix and cleats adjacent to the injection well. After recycling has ceased and the injection well is converted back to production, a large amount of gas that had previously been stored in the matrix under high pressure is suddenly released resulting in a sharp increase in the rate immediately after the injection well begins producing.

In summary, the reasons for the increased gas rate after reinjecting all of the produced gas for 180 days are the coal's preference to flow gas in the immediate area surrounding the producing wells is maintained, and coal seam pressure is increased around the injection well. In other words, the gas reinjection process prepares the coal seam for high deliverability in the future by dewatering the coal seam even when the demand for gas is low.

When all of the wells in the field are shut-in, as depicted in Curve II, the water saturation in the coal cleats adjacent to the wells increases with time because of water migration from the flanks of the coal seam and because dewatering of the coal by the wells has been stopped. The reservoir pressure around the wellbores increases due to the influx of water during the shut-in period. Consequently, when the wells are put back on production, the reservoir pressure and water saturation of the coal adjacent to the wellbores must be reduced to levels achieved prior to shut-in in order to produce gas at high rates. In other words, if the demand for gas fluctuates considerably over the life of the field the water influx problems illustrated by this prior art method get progressively worse.

The operation of recycling during low demand and producing during high demand can continue for the life of the field. The number of producing wells drilled in the field can vary depending on the size of the field and the demand for gas. The number and location of producing wells converted to injection wells can vary depending upon, among other things, the size of the field and the amount of time the field has been operating. The injected gas can originate from the same coal seam where the gas is injected or from a coal seam other than the one where the gas is injected or from a reservoir other than a coal seam. The gas can be injected at a pressure higher than coal seam pressure, but lower than fracture pressure of immediately adjacent formations above or below the coal seam, or at a pressure dictated by prudent operating procedures.

Since some water is usually produced with the gas, conventional methods of separating the two can be used before the gas is injected into the coal seam.

Obviously, many other variations and modifications of this invention, as previously set forth, may be made without departing from the spirit and scope of the invention as those skilled in the art will readily understand. Such variations and modifications are considered part of this invention and within the purview and scope of the appended claims.

We claim:

1. A method of increasing the natural gas production rate after a period of reduced net natural gas production from a subterranean coal seam penetrated by at least a first and a second well, comprising:

(a) removing natural gas and liquid from the coal seam through a first well;

(b) separating natural gas from the liquid; and (c) injecting at least a portion of the separated natural gas during the period of reduced natural gas production into the coal seam through a second well while continuing to remove natural gas and liquid from the coal seam through the first well.

2. A method of claim 1 wherein the liquid comprises water.

3. A method of claim 1 wherein the gas is dewatered before it is injected.

4. A method of claim 1 wherein step (a) further comprises removing natural gas and liquid from a coal seam other than the coal seam in which the gas is being injected in step (c).

5. A method of claim 1 wherein the method includes additional step (d) ceasing the injection of gas into the coal seam and removing gas and liquid from each well.

6. A method of producing natural gas from a coal seam, comprising:

(a) producing natural gas and liquid from a coal seam through at least one well;

(b) ceasing the production of natural gas and liquid from the coal seam and injecting natural gas into the coal seam through the at least one well at a pressure higher than coal seam pressure but lower than fracture pressures of immediately adjacent formations above or below the coal seam; and (c) subsequently producing natural gas and liquid from the coal seam through the at least one well.

7. A method of claim 6 wherein the gaseous feed in step (b) originates from formations other than a coal seam.

* * * * *